US007568740B2

(12) United States Patent
Brose et al.

(10) Patent No.: US 7,568,740 B2
(45) Date of Patent: Aug. 4, 2009

(54) MOTOR VEHICLE LOCK

(75) Inventors: Simon Brose, Hattingen (DE); Checrallah Kachouh, Dortmund (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 152 days.

(21) Appl. No.: 11/086,681

(22) Filed: Mar. 23, 2005

(65) Prior Publication Data

US 2005/0218661 A1 Oct. 6, 2005

(30) Foreign Application Priority Data

Mar. 23, 2004 (DE) ..... 10 2004 014 550
Mar. 23, 2004 (DE) ..... 10 2004 014 551
Apr. 2, 2004 (DE) ..... 10 2004 017 014

(51) Int. Cl.
*E05C 3/16* (2006.01)

(52) U.S. Cl. ..... 292/216; 292/201; 292/DIG. 23

(58) Field of Classification Search ..... 292/216, 292/201 X, DIG. 62, DIG. 23 X
See application file for complete search history.

(56) References Cited

U.S. PATENT DOCUMENTS 4,364,249 A * 12/1982 Kleefeldt ..... 70/264
5,921,595 A 7/1999 Brackmann et al.
6,062,613 A 5/2000 Jung et al.
6,067,826 A * 5/2000 Holloway et al. ..... 70/278.3
6,116,664 A * 9/2000 Wegner ..... 292/216
6,343,817 B1 * 2/2002 Watanabe ..... 292/216
6,367,296 B1 4/2002 Dupont
6,428,058 B1 8/2002 Graute
6,568,722 B2 5/2003 Raffelsiefer et al.
7,086,257 B2 8/2006 Bücker et al.
2003/0116977 A1 6/2003 Erices

FOREIGN PATENT DOCUMENTS

DE 197 02 420 A1 7/1998
DE 199 48 315 A1 4/2001
DE 102 39 698 A1 3/2004
EP 0 710 755 B1 5/1996

OTHER PUBLICATIONS

Motor Vehicle Door Lock With Anit-Theft Device, Jörg Reinert, May 2000, Robert Bosch GMBH, Stuttgart, Germany.

* cited by examiner

*Primary Examiner*—Patricia Engle
*Assistant Examiner*—Mark Williams
(74) *Attorney, Agent, or Firm*—David S. Safran; Roberts Mlotkowski; Safran & Cole, P.C.

(57) ABSTRACT

Motor vehicle lock with a ratchet, latch, actuation lever, internal actuation chain, external actuation chain and a control, the ratchet having an engagement position in which it holds the latch in the closed position, and a raised position in which the latch is released, the ratchet being movable from the engagement position into the raised position by the actuating lever, the control having different operating states and depending on the state, the ratchet is actuatable via the actuation lever by the internal actuation chain from an inside door handle and/or by the external actuation chain from an outside door handle or not at all. In the base state, the internal actuation chain and the external actuation chain are coupled to the actuation lever and the internal actuation chain and/or the external actuation chain can be decoupled from the actuation lever by the control depending on the operating state.

40 Claims, 12 Drawing Sheets

MOTOR VEHICLE LOCK

BACKGROUND OF THE INVENTION

1. Field of Invention

This invention relates to a motor vehicle lock. The motor vehicle lock is especially suited as a side door lock, but can also be used for other motor vehicle locks which have at least two actuation chains.

2. Description of Related Art

The concept "actuation chain" quite generally designates a chain of action of forces between a first actuation element, such as a door handle, for example, and a second actuation element, such as, ultimately, a ratchet.

For motor vehicle locks, especially those for side doors of motor vehicles, providing two actuation chains from the outside door handle and the inside door handle to the ratchet is known. In a classic version of such a motor vehicle lock (German Patent Application DE 195 19 010 A1 and corresponding U.S. Pat. No. 5,921,595) the two actuation chains each have lever arrangements which are independent of one another and which act on the ratchet itself or on an actuation lever of the ratchet. For each actuation chain, there must be several levers in order to engage different operating states. Due to the host of existing levers, it is often necessary to arrange the levers distributed at a right angle to one another on a support structure which is made right-angled. Thus, the installation situation of such a motor vehicle lock changes.

For the motor vehicle lock which forms the starting point of this invention (German Patent Application DE 196 31 869 A1 and corresponding U.S. Pat. No. 6,062,613), it was recognized that a single control means is enough for the two actuation chains and complex lever constructions can be omitted if a flat plate-like configuration with elements which can move only lengthwise is chosen. For this reason, this motor vehicle lock has a control means as well as an internal actuation chain and an external actuation chain. These actuation chains, in the base state, are decoupled from the actuating lever of the ratchet and are coupled to the actuation lever by the control means depending on the operating state. Since the actuation chains are conventionally decoupled, there is moreover an emergency actuation device which couples the actuation chains to the actuation lever in an emergency, for example, when the control means fails.

The control means is made here as a control disk with cams for different operating states. To reach a certain operating state, it is necessary for the control disk to be moved mechanically or by a motor into defined positions. Sensors are necessary for defined reaching of the individual positions, for which reason the control is relatively complex. Furthermore, it is disadvantageous that the decoupled position of the actuation chains is implemented by one spring at a time. However, springs are complex to install, and moreover, are relatively susceptible to faults.

Furthermore, in practice, it has been shown that linearly movable elements of the actuation chains are not feasible over the long term. Wear and corrosion are difficult to handle there.

The expression "control means" here means the totality of components, such as levers, etc., which switch the internal actuation chain and/or the external actuation chain to be active or inactive with respect to actuation of the ratchet. This switching takes place depending on the different operating states. Different operating states are, for example, "Center lock" (CL), "Unlock" (UL), "Double lock" (DL) and "Child safety" (CS). In the UL operating state, the door can be opened by actuating the inside door handle and the outside door handle. In the CL operating state, the door cannot be opened by actuation of the outside door handle, but by actuation of the inside door handle. In the DS operating state the door cannot be opened either by actuation of the outside door handle or by actuation of the inside door handle. The door cannot be opened even after breaking into the vehicle. In the CS operating state, the door can be opened by actuating the outside door handle, but not by actuating the inside door handle.

Another known motor vehicle lock (German Patent DE 100 38 151 C2 and corresponding U.S. Pat. No. 6,568,722) has both a "DL" operating state in which the ratchet cannot be moved into its raised position, either by actuation of the outside door handle or by actuation of the inside door handle, and a "CL" operating state in which the ratchet can be moved into its raised position only by actuation of the inside door handle. The motor vehicle lock omits an inside locking button, the function of which is assumed by the inside door handle. For this purpose, a first stroke is assigned to the inside door handle and switches the control means of the motor vehicle lock from the "CL" operating state into the "UL" operating state. Then, the ratchet can be moved into its raised position by a second stroke.

A motor vehicle door lock (German Patent Application DE 101 39 975 A1 and corresponding U.S. Patent Application Publication 2003/0116977) is also known which has a central locking drive with which a control means can be switched between a "center lock" (CL) operating state and an "unlock" (UL) operating state. The ratchet in the UL operating state of the control means is normally shifted into the raised position which releases the latch by actuating an outside door handle. However, when the outside door handle in the CL operating state is actuated so quickly that the central locking drive cannot move the control means fast enough into the UL operating state, the central locking drive assumes the opening function. The ratchet is then moved into its raised position by the central locking drive.

Another known motor vehicle lock (European Patent Publication EP 0 710 755 B1) has a central locking drive with which a control means can be switched from the CL operating state into the UL operating state and vice versa. Moreover, the central locking drive is additionally set up as an opening drive with which a ratchet can be moved out of its engaged position which holds the latch into its raised position which releases the latch. The two functions (opening function and central locking function) of the central locking drive are achieved by a motor being coupled to the transmission element and driving it. For the central locking function, the transmission element is turned clockwise out of the initial position or counterclockwise back into the initial position. This movement defines a first range of motion of the transmission element to which the central locking function is assigned. The opening function is assigned to a second range of motion of the transmission element. This range of motion is defined by the swivelling of the transmission element out of the initial position counterclockwise and back into the initial position. In the initial position, the motor consequently acts on the transmission element in the middle, i.e., between the two ranges of motion. The use of two different ranges of motion for the different functions is unfavorable in this respect since, in this way, an altogether relatively large range of motion is necessary. Accordingly, the transmission element must be made accordingly large and a correspondingly large installation space is necessary.

SUMMARY OF THE INVENTION

A primary object of this invention is to devise a motor vehicle lock which enables optimized actuation of different operating state and in doing so reduces costs.

This object is achieved first of all by a motor vehicle lock of the above mentioned type having a control means with a base state in which the internal actuation chain and the external actuation chain are coupled to the actuation lever and in which the internal actuation chain and/or the external actuation chain can be decoupled from the actuation lever by the control means depending on the operating state.

The teaching of the invention is based on the fundamental idea that it is possible to couple both the internal actuation chain and also the external actuation chain already in the base state to the actuation lever of the ratchet. Here, complex lever constructions for the actuation chains are also omitted. However, a complex emergency actuation means is also saved, thus reducing costs. Moreover, the triggering of the different operating states of the control means is simplified. Sensors can be omitted for the most part. The construction should be implemented as much as possible with pivotally mounted elements. This does not preclude the fact that elements which are arranged to be able to move lengthwise individually over certain paths, for example, slot supports, can be implemented.

The concept "actuation chain", more accurately "internal actuation chain" and "external actuation chain," here means a chain of action of forces between the inside door handle and the outside door handle and the actuation lever. The respective actuation chain is executed as simply as possible here, i.e., with as few components as possible, preferably only with a Bowden cable.

In a preferred version, the two actuation chains are supported with respect to the actuation lever such that, when one chain is actuated, the other chain is not moved with it. This makes it possible, when one door handle is actuated, for the other door handle to remain in its position and to not be swung at the same time.

It is also advantageous if the control means has a central locking clutch which in its base state is located between the ratchet and the actuation lever. The base state of the central locking clutch here represents the UL operating state, in which the central locking clutch couples the actuation element to the ratchet by its action. By moving the central locking clutch out of its base state, the ratchet and the actuation lever are decoupled from one another by this action so that the control means reaches the CL operating state in any case.

It is moreover especially advantageous if the actuation lever and the central locking clutch are pivotally mounted on the same axle. In this way, it is not necessary to provide different bearing points for the actuation lever and the central locking clutch so that the costs for the motor vehicle lock are reduced.

Furthermore, it is preferable to provide a central locking lever by which the central locking clutch can be moved from its position which corresponds in any case to the UL operating state of the control means into its position which corresponds in any case to the CL operating state.

In addition, it is advantageous if the central locking lever can be driven by a motor so that the central locking clutch can be moved into its corresponding positions by a motor.

It is also advantageous if the control means has an overriding lever which can be moved by means of the internal actuation chain by actuation of the inside door handle such that the central locking clutch can be moved from its position which corresponds to the CL operating state into its position which corresponds to the UL operating state. In this way, it is possible for actuation of the ratchet by means of the inside door handle to be ensured in the CL operating state, although, in itself, the actuation lever and the ratchet are decoupled altogether by the central locking clutch.

Depending on the configuration, it is possible for the ratchet to be movable into its raised position when the control means is in the CL operating state only by one stroke or for the first stroke of the inside door handle to cause simply motion of the central locking clutch into its position which corresponds to the UL operating state of the control means and for the second stroke to cause displacement of the ratchet into its raised position.

It is also especially advantageous if the control means has the DL operating state in which the central locking clutch is moved into its position which corresponds to the CL operating state and the internal actuation chain is decoupled from the actuation lever. This constitutes an especially simple implementation of double locking without changing the manner of operation of the central locking clutch.

In another preferred configuration, the control means, moreover, has a CS operating state in which the ratchet can be actuated by the external actuation chain, but not by the internal actuation chain. In this operating state, children are prevented from inadvertently opening the door. This is achieved especially in that the internal actuation chain is swivelled out of the range of action of the actuation lever. Therefore, with respect to child safety, the CS operating state corresponds to the DL operating state to the extent the internal actuation chain is affected.

Depending on the configuration of the motor vehicle lock, it is necessary to swivel the internal actuation chain out of the range of action of the overriding lever. In another case, however, it can also be desirable for the internal actuation chain to remain in the action range of the overriding lever. This is especially the case when the control means of the motor vehicle lock when the motor vehicle starts off automatically switches into the CL operating state in order to prevent an individual from getting into the motor vehicle without authorization when the vehicle is temporarily stopped. However, it can also be necessary, for example, in an accident, for a child to enable admittance to another individual. This is enabled in that in the CS operating state, differently than in the DL operating state, the overriding lever is actuated as soon as the child actuates the inside door handle, so that unlocking takes place with respect to actuation of the outside door handle. Except for the decoupling of the internal actuation chain, the control means with respect to the door again reaches the UL operating state.

In addition, it is advantageous if there is an opening drive by which the ratchet can also be actuated by a motor. Here, it is especially advantageous if the central locking drive is, at the same time, also an opening drive, as is described below.

It is also especially advantageous if all levers of the motor vehicle lock are located in essentially parallel planes. The motor vehicle lock then has a low installation height and power transmission between the individual levers is optimized. The angular arrangement of the levers on a support structure can be omitted here.

Furthermore, another object of this invention is to improve the optimized actuation of different operating states with respect to use of the range of motion of the central locking drive with the inclusion of an opening function.

This object is achieved by the motor vehicle lock in which the opening function takes place in a first direction of motion of the central locking drive and wherein the range of motion of the central locking drive in the central locking function coincides at least in part with the range of motion of the central locking drive in the opening function.

The teaching of the invention is based on the finding that it is possible, both for the central locking function and also for the opening function, to use at least in part the same range of motion of the central locking drive. In this way, it is possible to make the element which is driven by the central locking drive smaller than was conventional in the past, since the range of motion which is necessary for the two functions is reduced.

The invention can be used especially advantageously in motor vehicle locks with opening actuation which is normally carried out mechanically from the outside door handle. The opening function of the central locking drive is then important when the outside door handle is pulled or pressed more quickly than a control means for triggering the central locking drive and the central locking drive itself can react; this can occur in the implementation of a "passive entry" function, also called an "electronic key." Specifically, when the central locking drive still has not been able to carry out unlocking, the central locking drive in the opening function takes effect and moves the ratchet into its raised position so that repeated actuation of the outside door handle is not necessary.

In a preferred version, for the opening function of the central locking drive, there is an opening clutch which has an opening readiness position in which to raise the ratchet the clutch can be caused to engage the latter. The central locking function can then be maintained essentially without changes.

It is also advantageous if a central locking lever, which is provided for the central locking function, is also used for an opening function. In this way, other components which are driven by the central locking drive can be omitted.

It is especially advantageous if the central locking lever has a control contour for the opening function, since a control contour can be implemented especially easily and economically.

It is furthermore advantageous if the opening clutch can be released out of its initial position by actuation of an actuation element, especially of the outside door handle, and only then can it be moved into its opening readiness position. This results in that actuation of the ratchet normally takes place mechanically and the central locking drive carries out its function only by way of exception, for example, when the outside door handle has been pulled too quickly.

Furthermore, it is preferred that the opening clutch is pretensioned in the direction of its opening readiness position and in the direction of a stop which is located on a clutch carrier. In this way, it becomes possible for the opening function to be carried out by the central locking drive only in one direction of motion. Motion of the central locking drive in the other direction of motion does not influence the opening function. The ratchet can thus be raised by the motion of the central locking drive in the first direction of motion, but not in the second direction of motion, when the opening clutch is in the opening readiness position.

It is also preferred that there be stops for the central locking drive so that the latter can be operated in a blocking mode. In this way, it is possible to eliminate sensors for detection of the position of the central locking drive.

Within the framework of another configuration, it is possible to assign several functions to a spring which is present anyway in the motor vehicle lock, specifically actuation by the spring, on the one hand, and safeguarding of the end position, on the other. In this way, it is possible to eliminate an additional spring, if necessary. In particular, the spring which is present anyway can additionally provide the function of a tilt spring. Then, this spring can act, on the one hand, as a reset spring, and on the other, as a tilt spring. This measure makes it possible to use the different spring functions both for the internal actuation chain and also for the ejection lever.

Other details, features, objectives and advantages of this invention are explained in detail below with reference to the accompanying drawings which show a preferred embodiment.

DETAILED DESCRIPTION OF THE INVENTION

Figure 1:
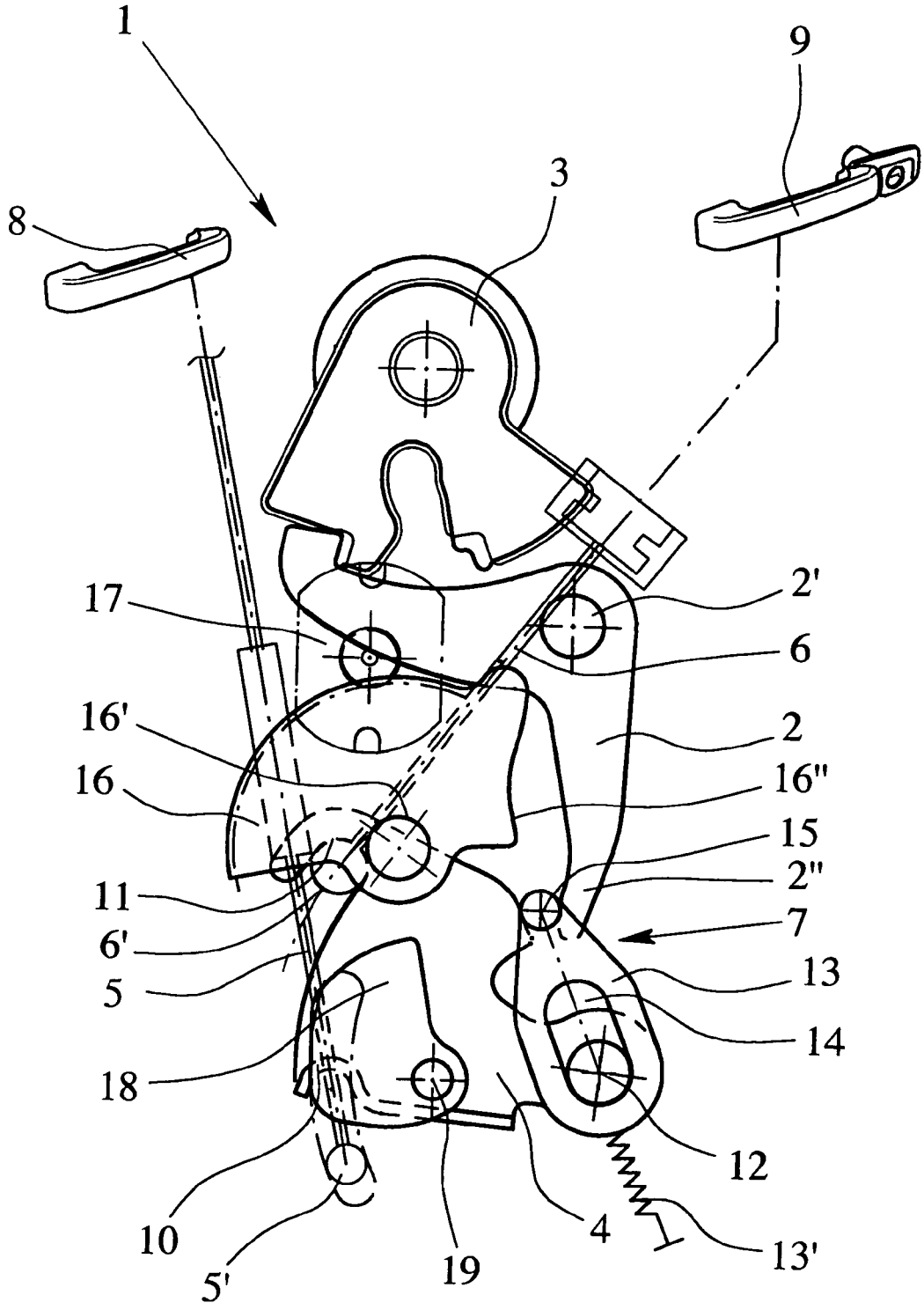
FIG. 1 shows a schematic of a motor vehicle lock in the UL operating state.

In the figures, the same reference numbers are used for the same or similar parts. This is intended to indicate that the corresponding or comparable properties and advantages are achieved even if a repeated description of these parts is omitted. If in the drawings overlapping of components occurs which functionally seems to contradict the described sequences, it must be considered that the elements can be located in different planes. Collisions are therefore present only in the drawings, not in reality.

FIG. 1 shows a view of a motor vehicle lock with a ratchet 2 and a latch 3. The ratchet 2 has an engaged position (FIG. 1) in which it keeps the latch 3 in the closed position. In addition, the ratchet 2 has a raised position (not shown) that can be reached by swivelling counterclockwise the ratchet 2 around the pivot pin 2', for example, influenced by the application of force of the actuation arm 2" (to the right in FIG. 1) in which the latch 3 is released.

Furthermore, the motor vehicle lock 1 has an actuation lever 4, an internal actuation chain 5, an external actuation chain 6 and a control means 7. The ratchet 2 can be moved out of its engaged position into its raised position by means of the actuation lever 4. Here, this means that the ratchet 2 can be moved directly or indirectly by the actuation lever 4 actively into its raised position, or that the actuation lever 4 directly or indirectly releases the ratchet 2 and the latter is moved into its raised position as a result of a pre-tensioning force, for example, provided by a spring. The illustrated embodiment shows a first version.

The internal actuation chain 5 establishes a chain of action of forces between the inside door handle 8 and the actuation lever 4. The external actuation chain 6 establishes a chain of action of forces between the outside door handle 9 and the actuation lever 4. The two actuation chains 5, 6 are located on the actuation lever 4 such that it can be actuated from the inside door handle 8 and/or the outside door handle 9 depending on the operating state of the control means 7. This can take place in the UL operating state (FIG. 1) in that the actuation lever 4 is swung clockwise and presses the actuation arm 2" of the ratchet 2 to the right in FIG. 1 via a cam 15 which will be explained later.

The control means 7 here preferably has the above explained operating states "Unlock" (UL), "Center lock" (CL), "Double lock" (DL) and "Child safety" (CS).

In the base state, the internal actuation chain 5 and the external actuation chain 6 are coupled to the actuation lever 4. The base state is the state in which both the internal actuation chain 5 and also the external actuation chain 6 are at rest. This means that neither the inside door handle 8 nor the outside door handle 9 has been pulled, nor that a spring which may be present is tensioned in one of the actuation chains 5, 6. This base state corresponds here to the UL operating state of the control means 7.

Permanent coupling of the internal actuation chain 5 and the external actuation chain 6 to the actuation lever 4 in the base state results in that the motor vehicle lock 1, when no additional force is acting, returns by itself back into this state. In this way, it is possible to omit an emergency actuation device since mechanical actuation of the motor vehicle lock 1 in the operating states of the control means 7 from which emergency actuation is to be possible is now guaranteed. To reach operating states of the control means 7 other than the base state, here the UL operating state, it is possible to decouple the internal actuation chain 5 and/or the external actuation chain 6 from the actuation lever 4 by the control means 7.

Here, preferably, the internal actuation chain 5 and the external actuation chain 6 are supported with respect to the actuation lever 4 such that, when the actuation lever 4 is actuated by an actuation chain 5, 6, the other actuation chain 6, 5 is not moved at the same time. In order to do this, the actuation lever 4 has a stop 10 for the internal actuation chain 5 and a stop 11 for the external actuation chain 6. The internal actuation chain 5 is located on the actuation lever 4 such that one end 5' of the internal actuation chain 5 adjoins the stop 10. The direction of one end 5' of the internal actuation chain 5 opposite the stop 10 conversely is free so that the internal actuation chain 5 is not entrained when the actuation lever 4 is moved. Analogously, one end 6' of the external actuation chain 6 is located on the stop 11 of the actuation lever 4. Instead of a stop 10, 11, however, on the actuating lever 4 there can also be a slot which provides a backlash connection for relative movements.

The internal actuation chain 5 and the external actuation chain 6, here, are made as Bowden cables with an end 5', 6', which adjoins the respective stop 10, 11 of the actuation lever 4 being a Bowden cable drum. The Bowden cable drum 5', 6' of the respective actuation chain 5, 6 therefore adjoins the corresponding stop 10, 11 such that the actuation lever 4 is swung by the actuation of the respective actuation chain 5, 6. For this purpose, the actuation lever 4 is pivotally supported on the pivot pin 12. The stops 10, 11 of the actuation lever 4 are arranged such that actuation by the internal actuation chain 5 and the external actuation chain 6 causes motion of the actuation lever 4 (FIG. 3) in the same direction of motion. Instead of a Bowden cable, an actuation rod can also be used in a corresponding arrangement.

Furthermore, the control means 7 of the motor vehicle lock 1 has a central locking clutch 13. Here, the clutch 13 is, preferably, pivotally supported on the same pivot pin 12 as the actuation lever 4. The central locking clutch 13 has a slot 14 by means of which it is supported on the pivot pin 12. In this way, the central locking clutch 13, on the one hand, can be swung around the pivot pin 12, and on the other hand, can be moved relative to the pivot pin 12 in the slot 14.

Furthermore, the central locking clutch 13 has a cam 15 (or another contour) which is coupled to the ratchet 2 and the actuation lever 4 in the UL operating state of the control means 7 by its action (FIG. 1). Action coupling is achieved here by the cam 15 of the central locking clutch 13 being located between the ratchet 2 and the actuation lever 4 and adjoining the two. So that the control means 7 reaches the UL operating state, the central locking clutch 13 in the slot 14 is shifted into the end position under a spring force.

Figure 2:
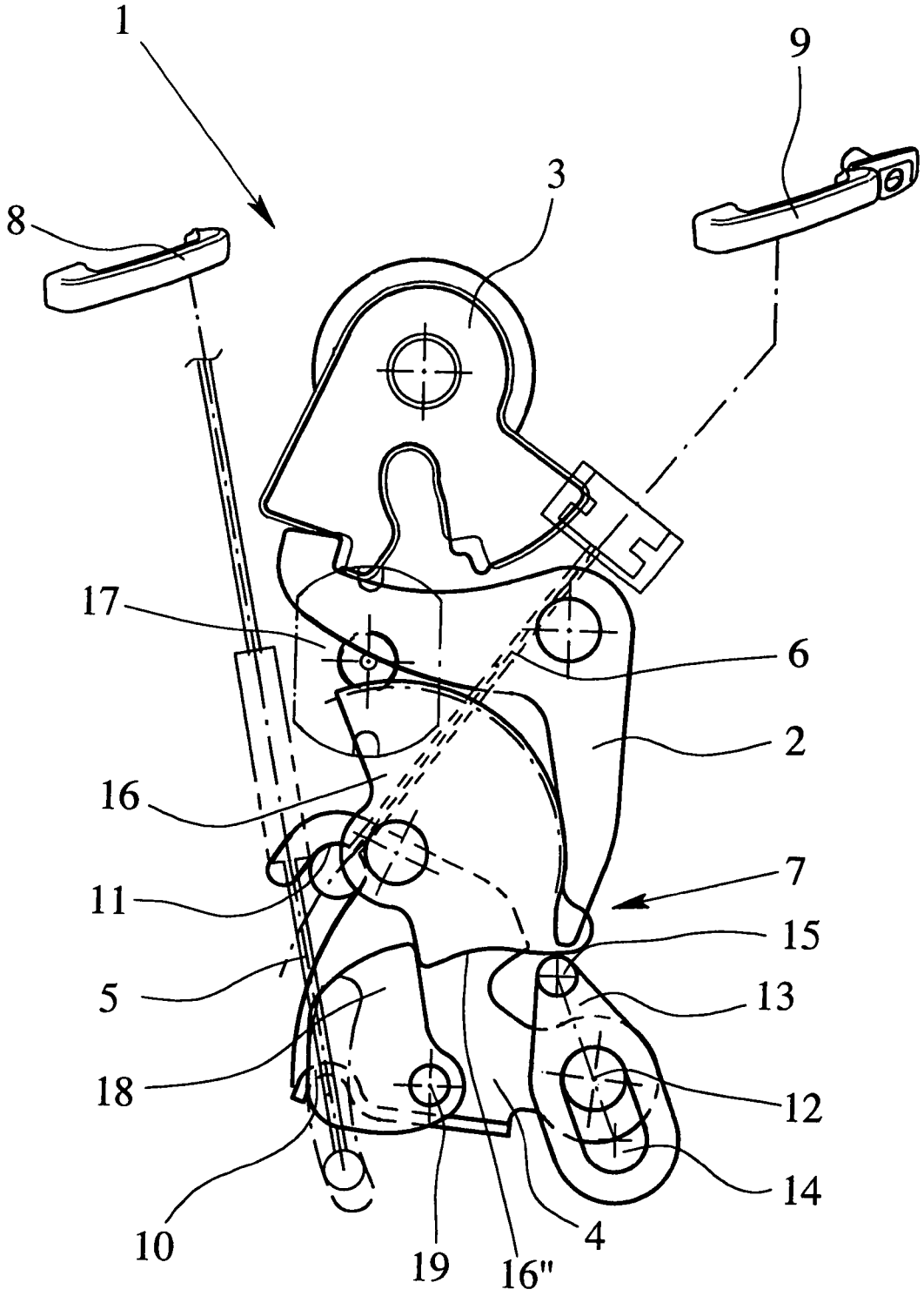
FIG. 2 shows the motor vehicle lock from FIG. 1 in the CL operating state.
Figure 3:
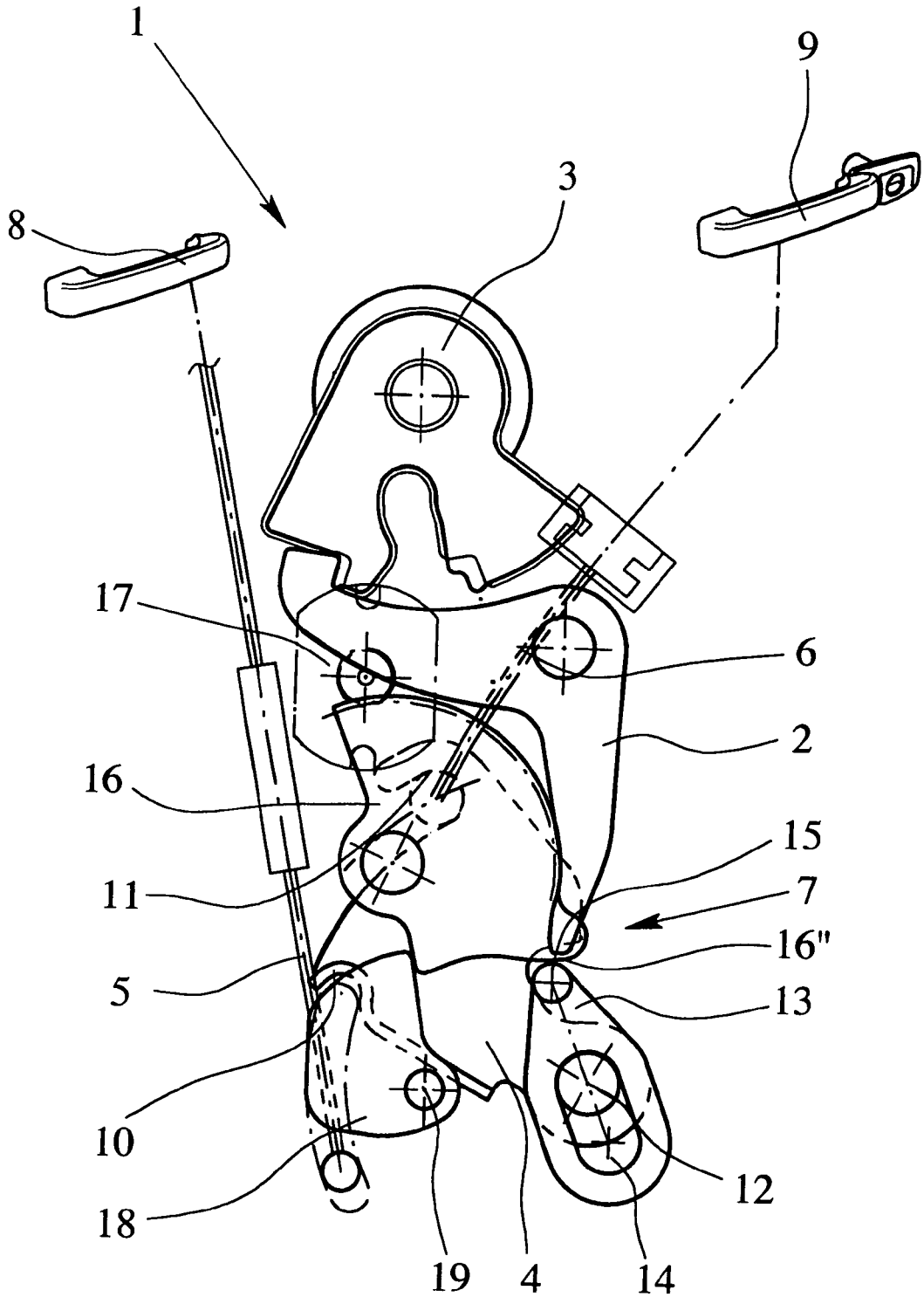
FIG. 3 shows the motor vehicle lock from FIG. 2 with the outside door handle pulled.
Figure 4:
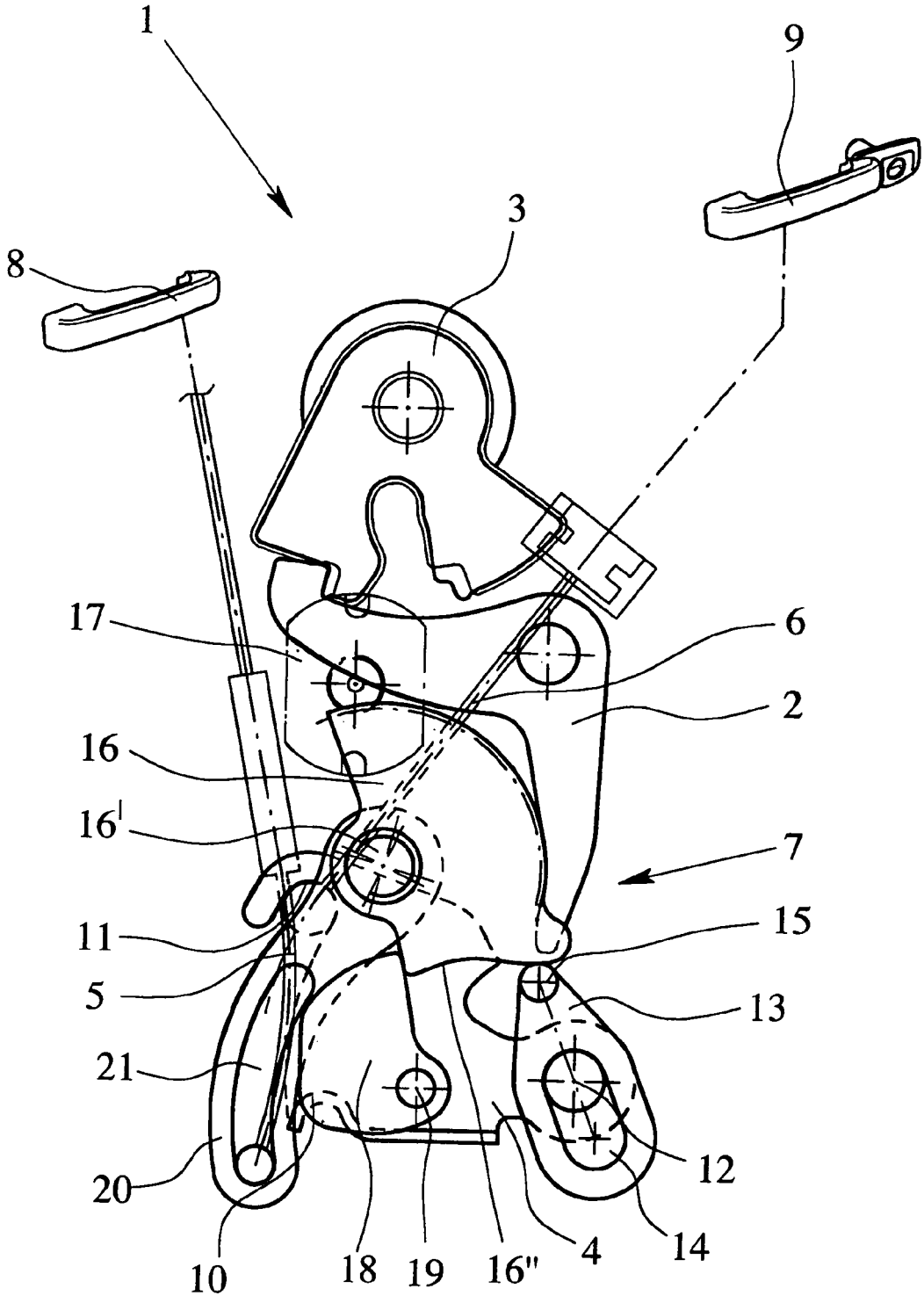
FIG. 4 shows the motor vehicle lock from FIG. 1 in the DL operating state.

The central locking clutch 13 is in the other end position in the slot 14 when the control means 7 assumes the CL or DL operating states (FIGS. 2, 3, 4). In this position, the cam 15 of the central locking clutch 13 is decoupled from the ratchet 2 and the actuation lever 4 by its action.

Here (FIGS. 2, 3, 4), decoupling is achieved by the central locking clutch 13 and with it the cam 15 being pushed out of the area between the ratchet 2 and the actuation lever 4. When the actuation lever 4 is actuated by the internal actuation chain 5 or the external actuation chain 6, in this case, the ratchet 2 is not moved out of its engaged position. The actuation lever 4 runs under no-load.

The central locking clutch 13 here is preferably pre-tensioned by means of a spring 13' (FIG. 1) into its position which corresponds to the UL operating state of the control means 7. This pre-tensioning results in that the actuation chains 5, 6 are switched without effect only in the operating states of the control means 7 with respect to the ratchet 2, which states have been engaged beforehand by the control means 7.

Moreover, the pre-tensioning causes a storage position with respect to the central locking clutch 13. With the door handle 5, 6 pulled (FIG. 3) the central locking clutch 13 cannot be moved by actuation of the control means 7 out of its position corresponding to the CL and DL operating states of the control means 7 into its position which corresponds to the UL operating state of the control means 7, since the path of motion is blocked by the actuation lever 4 (FIGS. 2, 3). However, as soon as the blockage is removed, i.e. the actuation lever 4 has moved back into its initial position, the central locking clutch 13 is moved due to the pre-tensioning force into the position of the control means 7 which corresponds to the UL operating state (FIG. 1).

Furthermore, the control means 7 has a central locking lever 16 with which the central locking clutch 13 can be moved from its position which corresponds, in any case, to the UL operating state of the control means 7 into its position which corresponds to the CL or DL operating state. The central locking lever 16 is supported to be able to swivel around the pivot pin 16'. When the central locking lever 16 is swung out of the position which corresponds to the UL operating state of the control means 7 into the position which corresponds to the CL or DL operating state (FIGS. 2, 3, 4), the contact surface 16" of the central locking lever 16 engages the cam 15 of the central locking clutch 13. The central locking clutch 13 is thus shifted into its position which corresponds to the CL or DL operating state and is held in it by the central locking lever 16. Only when the central locking lever 16 is moved back again into its initial position, can the central locking clutch 13 return into its position which corresponds to the UL operating state. This takes place automatically as a result of the pre-tensioning force which acts on the central locking clutch 13 (FIG. 1).

Here, the control means 7, preferably, has a central locking drive 17 of the central locking lever 16. The central locking lever 16 can thus be shifted by a motor from its position which corresponds to the UL operating state (FIG. 1) into its position which corresponds to the CL or DL operating state (FIGS. 2, 3, 4) and back. The central locking drive 17 can be an electric motor, a pneumatic drive or a hydraulic drive.

An electric motor is preferred here. The electric motor is preferably operated in a blocking mode in order to be able to eliminate the need sensors for detection of the position of the central locking lever 16 which is driven by the electric motor. For blocking operation of the central locking lever 16, there are stops which are arranged appropriately. The positions of the central locking lever 16 corresponding to the UL and CL operating states are then reached when the lever adjoins a corresponding stop (not shown). Then, the electric motor is turned off in a certain position of the central locking lever 16 by torque monitoring, preferably in the form of current monitoring and/or timing.

It is also possible to provide mechanical actuation of the central locking lever 16 instead of the central locking drive 17 or in addition. This can take place, for example, by a lock cylinder which is assigned to the motor vehicle lock 1.

Furthermore, the control means 7 of the motor vehicle lock 1 shown here has an overriding lever 18 which is arranged and can be moved by means of the internal actuation chain 5 by actuating the inside door handle 8, such that the central locking clutch 13 can be moved out of its position which corresponds to the CL operating state into its position which corresponds to the UL operating state. The overriding lever 18 thus ensures that the ratchet 2 can be actuated by the internal actuation chain 5 when the control means 7 is in the CL operating state.

First of all, the position of the central locking clutch 13 for the DL operating state is the same as the position for the CL operating state. This would mean that the ratchet 2 cannot be actuated in the CL operating position of the control means 7 by the internal actuation chain 5. To prevent this, it is possible for the overriding lever 18 to move the central locking clutch 13 into its position which corresponds to the UL operating state. To do this, the overriding lever 18 is pivotally mounted on a pivot pin 19 on the actuation lever 4. It is pre-tensioned in this position by a spring (not shown).

The overriding lever 18 projects, in its normal position, into the path of motion of the internal actuation chain 5. By actuating the internal actuation chain 5, here specifically by the pin on the end 5' of the Bowden cable, the overriding lever 18 is swung. If, at this point, the central locking clutch 13 is in its position which corresponds to the CL operating state (FIG. 2), the overriding lever 18, as it swings around its pivot pin, engages the central locking lever 16 and swings it out of the position which holds the central locking clutch 13. The central locking clutch 13 can move back into its position which corresponds to the UL operating state due to the pre-tensioning force. The ratchet 2 can be actuated afterwards by the internal actuation chain 5.

The internal actuation chain 5 can be made such that the ratchet 2 is moved into its raised position by a single stroke of the inside door handle 8. This single stroke of the inside door handle 8 then moves first the central locking clutch 13 into its position which corresponds to the UL operating state of the control means 7, and then displaces the ratchet 2 into its raised position (single-stroke ejector, shown here).

However, the internal actuation chain 5 can also be made such that a first stroke of the inside door handle 8 moves the central locking clutch 13 into the UL operating state of the control means 7 and only the second stroke of the inside door handle 8 moves the ratchet 2 into its raised position. Reference is made here to DE 100 38 151 C2 and corresponding U.S. Pat. No. 6,568,722, the disclosure of which is hereby incorporated by reference (two-stroke ejector).

Here, the control means 7, preferably, has another operating state, specifically the DL operating state (FIG. 4). In the DL operating state, the ratchet 2 cannot be actuated either by the internal actuation chain 5 or by the external actuation chain 6. As explained above, the central locking clutch 13, in the DL operating state of the control means 7, assumes the same position as in the CL operating state.

In order to prevent possible actuation by means of the internal actuation chain 5, the internal actuation chain 5 is decoupled from the actuation lever 4. To do this, the control means 7 has an ejection lever 20 with a slot 21 (FIG. 4). The part in which slot 21 is formed is shown only beginning with FIG. 4 in order to facilitate the understanding of the other explanations, the slot itself being represented in dot-dash lines in FIGS. 1-3.

The ejection lever 20 is preferably supported here to be able to swivel around the same pin 16' as the central locking lever 16. The slot 21 of the ejection lever 20 is arranged such that, in the UL operating position, it overlaps the range of motion of the end 5' of the internal actuation chain 5. The internal actuation chain 5, here especially the Bowden cable drum 5' of the internal actuation chain 5, is supported and guided in the slot 21 of the ejection lever 20. Because the shape of the slot 21 is matched to the range of motion of the internal actuation chain 5, the actuation lever 4 can also be swung by the internal actuation chain 5.

In the DL operating state of the control means 7, the ejection lever 20 is swung around the pivot pin 16' such that the internal actuation chain 5 is decoupled from the actuation lever 4. For the position of the central locking clutch 13 which corresponds to the DL operating state and with the ejection lever 20 swung out, the ratchet 2 is thus protected against actuation both by the external actuation chain 6 and also by the internal actuation chain 5. In this case, the swinging-out of the Bowden cable drum 5' of the internal actuation chain 5 by the ejection lever 20 is used to bypass the overriding lever 18. The control means 7 is in the DL operating state.

Figure 5:
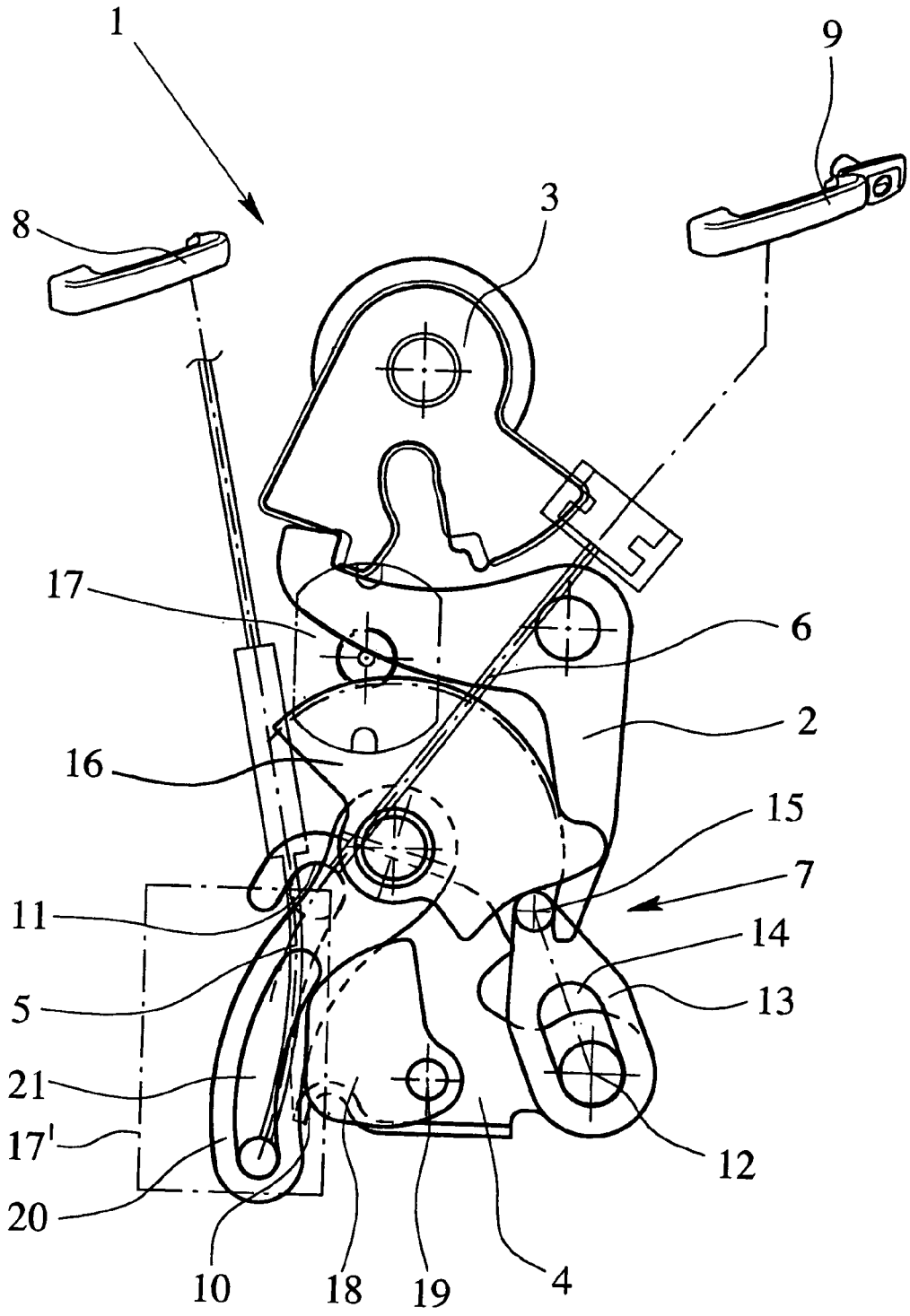
FIG. 5 shows the motor vehicle lock from FIG. 1 in the CS operating state.

The control means 7 of the motor vehicle lock 1 shown here additionally has a CS operating position (FIG. 5). In the CS operating position, the ratchet 2 can be actuated by means of the external actuation chain 6, but not by means of the internal actuation chain 5. The internal actuation chain 5 is decoupled here from the actuation lever 4 by swinging out the ejection lever 20, and conversely, the central locking clutch 13 is in its position which corresponds to the UL operating state (FIG. 1).

FIG. 5 shows that the internal actuation chain 5 is swung both out of the action range of the actuation lever 4 and also out of the action range of the overriding lever 18. The ejection lever 20 here, in this respect, has only its normal position and a swung-out position. The ejection lever 20 is swung into the same position both for the CS operating state and also for the DL operating state.

Here, the control means 7 preferably has another drive 17' (only shown by way of example in FIG. 5 of the drawings) by which the ejection lever 20 can be moved back and forth by a motor between its different positions. The drive 17' here is made preferably as an electric motor, but can also be made as a hydraulic or pneumatic drive. When the drive 17' is made as an electric motor, it is also operated preferably in the blocking mode so that the corresponding stops are assigned to the ejection lever 20. Likewise, manual actuation of the ejection lever 20 is also possible.

Preferably, there is also an opening drive with which the ratchet 2 can be raised by a motor. The opening drive can be arranged such that it drives the ratchet 2 directly or it drives the ratchet 2 indirectly, i.e., with the interposition of other components. Like previous drives, the opening drive is also made preferably as an electric motor, and is operated in the blocking mode. However, it can also be made as a hydraulic or pneumatic drive.

The opening drive can be formed by the central locking drive 17 according to an especially preferred embodiment. This is explained in particular below.

In the embodiment shown here, all levers are located in planes that are parallel to one another so that the motor vehicle lock has a low installation height and power transmission between the individual levers is optimized. Only the central locking drive 17 is located perpendicular to the levers. The motor vehicle lock 1 thus has a low installation height as a whole and which is somewhat greater only at the location of the central locking drive 17. However, the low installation height can also be implemented when the levers are not arranged in parallel planes, but in planes which deviate slightly from parallel. Here, it is also possible to maintain the installation height when an especially short lever is located perpendicular to the levers.

In summary the individual operating positions of the control means 7 are explained again:

When the control means 7 is in the UL operating position the central locking clutch 13 is engaged to the actuation lever 4 and the ratchet 2. The ratchet 2 can thus be moved into its raised position by the internal actuation chain 5 and also by the external actuation chain 6 (FIG. 1).

When the control means 7 is in the CL operating position the central locking clutch 13 is in its position decoupled from the ratchet 2 and the actuation lever 4. The ratchet 2 cannot be actuated by the external actuation chain 6. Actuation by the internal actuation chain 5 is ensured by the overriding lever 18 (FIGS. 2, 3).

When the control means 7 is in the DL operating state, the central locking clutch 13 is in its position which is decoupled from the ratchet 2 and the actuation lever 4. In addition, the internal actuation chain 5 is decoupled from the actuation lever 4 and is swung out of the action range of the overriding lever 18 so that the ratchet 2 cannot be actuated either by the internal actuation chain 5 or by the external actuation chain 6 (FIG. 4).

When the control means 7 is in the CS operating position, the central locking clutch 13 is in its position which is coupled between the ratchet 2 and the actuation lever 4. The internal actuation chain 5 is decoupled from the actuation lever 4 and is optionally swung out of the action range of the overriding lever 18. The ratchet 2 thus can be moved into its raised position by the external actuation chain 6, but not by the internal actuation chain 5 (FIG. 5).

Figure 6:
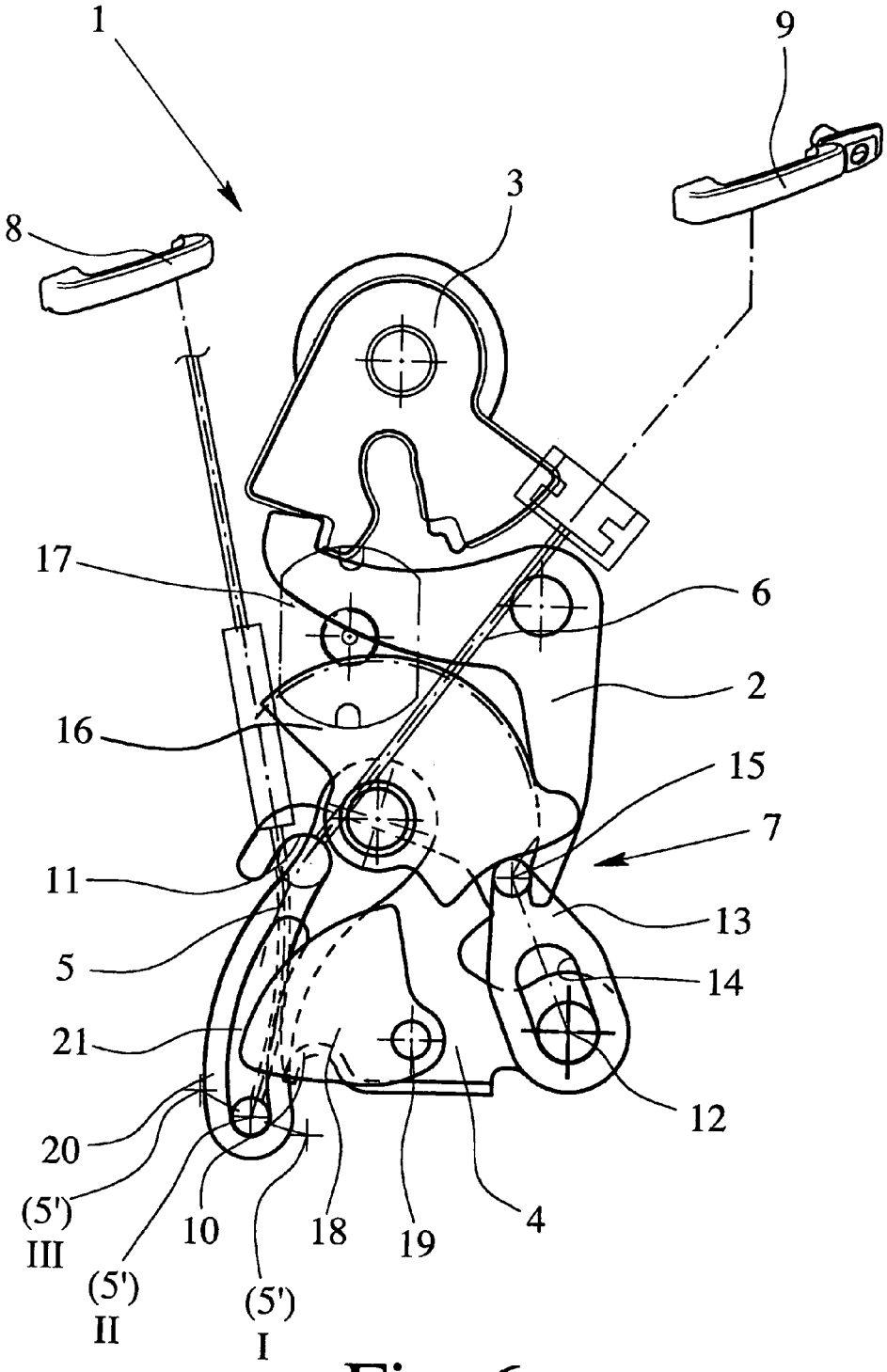
FIG. 6 shows another motor vehicle lock in the CS operating state.

FIG. 6 shows a motor vehicle lock 1 which is slightly modified as compared to the above described embodiment and which differs in that the ejection lever 20 provided here, in addition to its normal position I, has two ejection positions II, III. In the first ejection position II, the ejection lever 20 is decoupled from the actuation lever 4. The overriding lever 18 is, however, still in the range of motion of the internal actuation chain 5 with the Bowden cable drum 5'. This state is shown in FIG. 6.

The central locking clutch 13 can be moved by actuating the inside door handle 8 out of its position which corresponds to the CL operating state into its position which corresponds to the UL operating state. This function is helpful in a motor vehicle lock 1 in which the control means 7 is moved automatically into the CL operating position, for example, when the vehicle starts off, but the child safety is simultaneously retained. In an accident, it is possible for a child to enable access to another individual by pulling on the inside door handle 8 and the associated movement of the central locking clutch 13 out of the position which corresponds to the UL operating state. The CS operating state remains unaffected thereby.

The ejection lever 20 has a second ejection position III in which the internal actuation chain 5 is decoupled from the actuation lever 4 and is additionally swung out of the range of action of the overriding lever 18 so that the DL operating state is ensured when the central locking clutch 13 is in the position which corresponds to the DL operating state.

Figure 7:
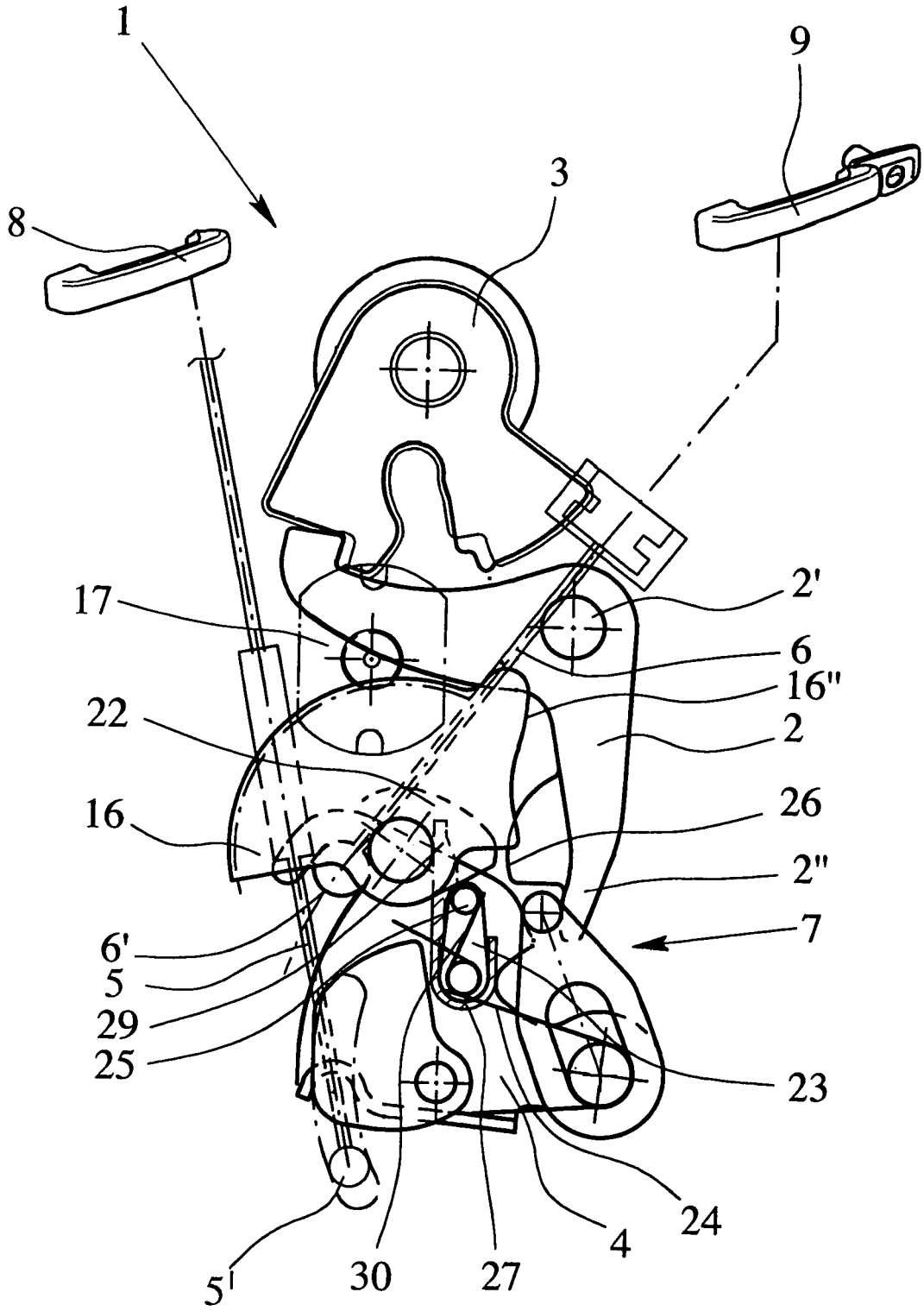
FIG. 7 shows another motor vehicle lock in the UL operating state with the opening clutch in the initial position.

FIG. 7 shows an embodiment which is altered relative to FIG. 1 with respect to the central locking drive 17. The central locking drive 17 here, besides the central locking function, has, in addition, another opening function. The opening function of the central locking drive 17 is used to move the ratchet 2 out of its engaged position into its raised position by a motor. The central locking drive 17 is made as above, but has additional components by means of which the opening function can be carried out.

The control means 7 can be switched as before by means of the central locking drive 17 in a first direction of motion from the CL operating state into the UL operating state and vice versa in a second direction of motion from the UL operating state into the CL operating state.

The opening function can be carried out by the central locking drive 17 only in the first direction of motion. The range of motion of the central locking drive 17 is not enlarged for this purpose, but the opening function is superimposed on one part of the already existing range of motion of the central locking drive 17.

The control means 7 as before has a central locking lever 16 which can be driven by a motor by means of the central locking drive 17. For the central locking function, there is the central locking clutch 13 which can be moved by the central locking lever 16.

In addition, the central locking lever 16 has a control contour 22 for the opening function. The control contour 22 is located permanently on the central locking lever 16 (and in FIG. 7, it is in the plane of the drawing under the central locking lever 16) and is consequently moved at the same time by the motion of the central locking lever 16. Here, the control contour 22 is preferably made as a worm cam; this is explained below.

Figure 8:
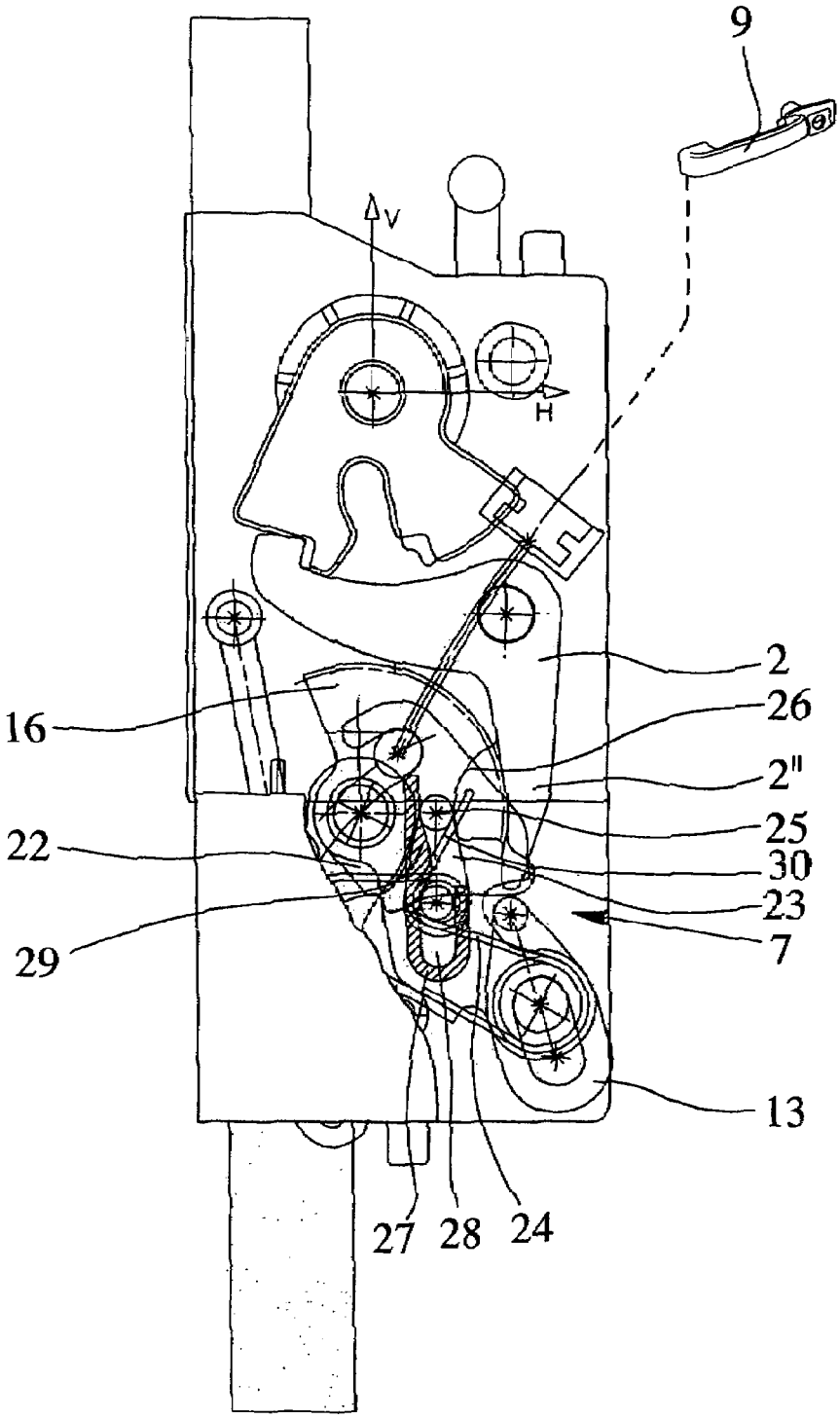
FIG. 8 shows the motor vehicle lock from FIG. 7 in the CL operating state and with the opening clutch in the opening readiness position.

The control means 7, in addition, has an opening clutch 23 for the opening function of the central locking drive 17. The opening clutch 23 has an initial position (FIG. 7) and an opening readiness position (FIG. 8). The opening clutch 23 is conventionally in its initial position and can be moved into its opening readiness position only during or after actuation of the outside door handle 9. The movement into its opening readiness position here takes place preferably by spring force. To do this, the opening clutch 23 is pre-tensioned in the direction of its opening readiness position by a spring 24. The opening clutch 23 remains held in this position, when the outside door handle 9 is not actuated, by an element which is not shown and which is dynamically connected to the outside door handle 9. If the outside door handle 9 is however actuated, the action of the spring force is released.

The opening clutch 23 is pivotally supported at least in its opening readiness position. Preferably, here it can also be swung in its initial position (FIG. 7), only to the right in FIG. 7. This ensures that the motion of the central locking lever 16 is not hindered when the opening clutch 23 is in the initial position.

The opening readiness position can be assumed by the opening clutch 23 here only after completion of the motion of the central locking drive 17 in the second direction of motion. The central locking drive 17 is in the CL operating state.

Figure 9:
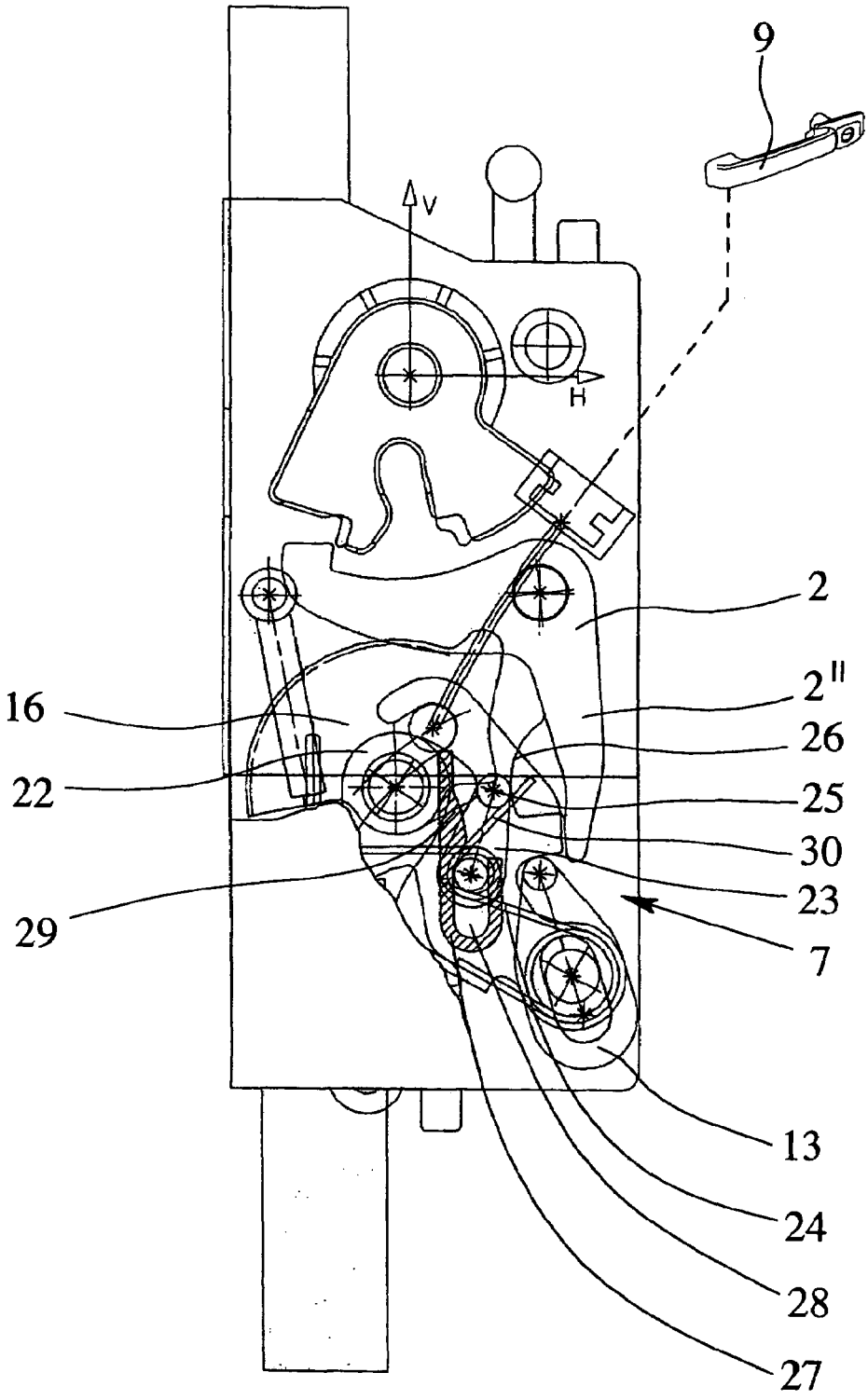
FIG. 9 shows the motor vehicle lock from FIG. 8 with the executed opening function of the central locking drive.

The opening clutch 23 has a cam 25 which can be caused to engage the ratchet 2 in the opening readiness position. To do this, the actuation arm 2" of the ratchet 2 has a projection 26. To raise the ratchet 2, the control contour 22 engages the cam 25 of the opening clutch 23 when the opening clutch 23 is in the opening readiness position. If the central locking drive 17 is actuated in this position, i.e., return of the central locking drive 17 into the UL operating state, the control contour 22 presses the cam 25 of the opening clutch 23 against the projection 26 of the ratchet 2 so that it is moved out of its engagement position into its raised position (FIG. 9).

The opening clutch 23 is supported to be able to swivel on the clutch carrier 27. The clutch carrier 27, for this reason, has a slot 28 in which the opening clutch 23 is supported. The opening clutch 23 can be moved from its initial position into the opening readiness position by the spring 24 in the slot 28 of the clutch carrier 27. The clutch carrier 27 has a stop 29 against which the opening clutch 23 is pre-tensioned in the opening readiness position by a spring 30.

The pre-tensioning against the stop 29 and the execution of the control contour 22 as a worm cam are used for the purpose of the ratchet 2 being raisable only by the motion of the central locking drive 17 in the first direction of motion, but not by the motion of the central locking drive 17 in the second direction of motion. This ensures that the opening function of the central locking drive 17 is executed only when this is actually desirable, i.e., when the system in itself is still in the CL operating state, but the outside door handle 9 has already been actuated too quickly for the system.

As above, the central locking drive 17 is made here such that it can be operated in a blocking mode. This means that, preferably, both directions of motion of the central locking drive (17) are limited by a stop (not shown).

The central locking function of the central locking drive 17 is carried out here as in the embodiments described in FIGS. 1 to 6. Here, the opening function, which is executed by the interplay of the control contour 22, the opening clutch 23 and the projection 26 of the ratchet 2, is additionally superimposed on the first direction of motion of the central locking drive 17. The opening function takes place here preferably only by a motor when the actuation of the outside door handle 9 takes place so quickly that the control means 7 could not be switched out of its CL or DL operating state fast enough into its UL operating state. The central locking lever 16, in this case, when the outside door handle 9 is actuated, is still in its position of the control means 7 which corresponds to the CL or DL operating state. The actuation of the outside door handle 9 enables the opening clutch 23 to be moved out of its initial position into its opening readiness position, so that the subsequent motion of the central locking drive 17 in the first direction of motion leads to raising of the ratchet 2. Repeated actuation of the outside door handle 9 is thus unnecessary since opening has taken place by a motor in this case.

Figure 10:
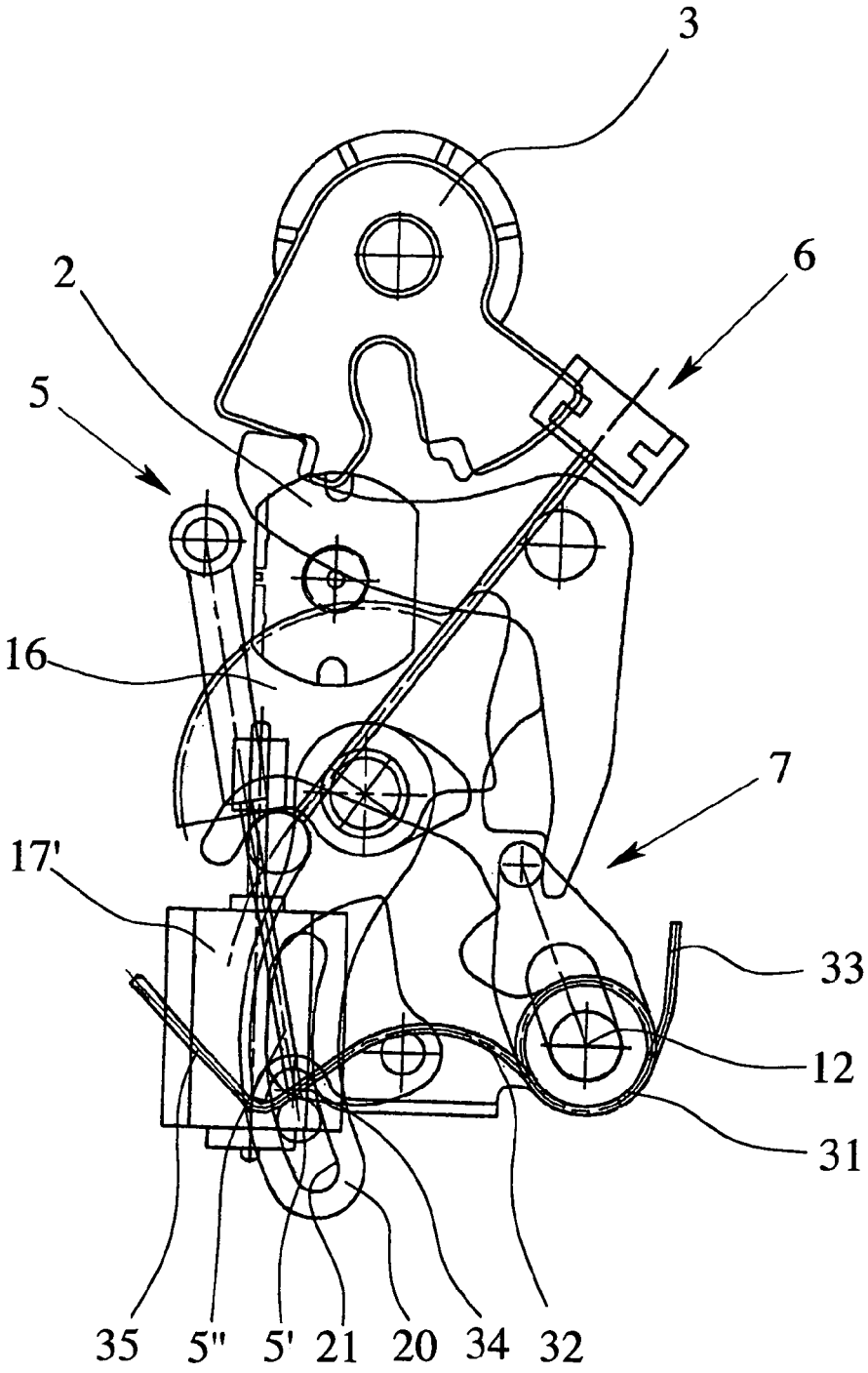
FIG. 10 shows another motor vehicle lock, again in the UL operating state.

FIG. 10 shows another embodiment which does not differ greatly in the manner of operation from the above described embodiments. The motor vehicle lock 1, as before, has a ratchet 2, a latch 3, here preferably two actuation chains 5, 6, and a control means 7. The ratchet 2, in turn, has an engagement position in which it holds the latch 3 in the closed position, and a raised position in which the latch 3 is released. The ratchet 2 can be moved by means of the actuation chains 4, 5 from the engaged position into the raised position depending on the operating state of the control means 7. The motor vehicle lock 1 shown here (FIG. 10) is in the UL operating state.

The control means 7, in turn, has different means for changing the operating state. In the embodiment described here, however, only the ejection lever 20, for example, as a means for changing the operating state is described below.

Figure 11:
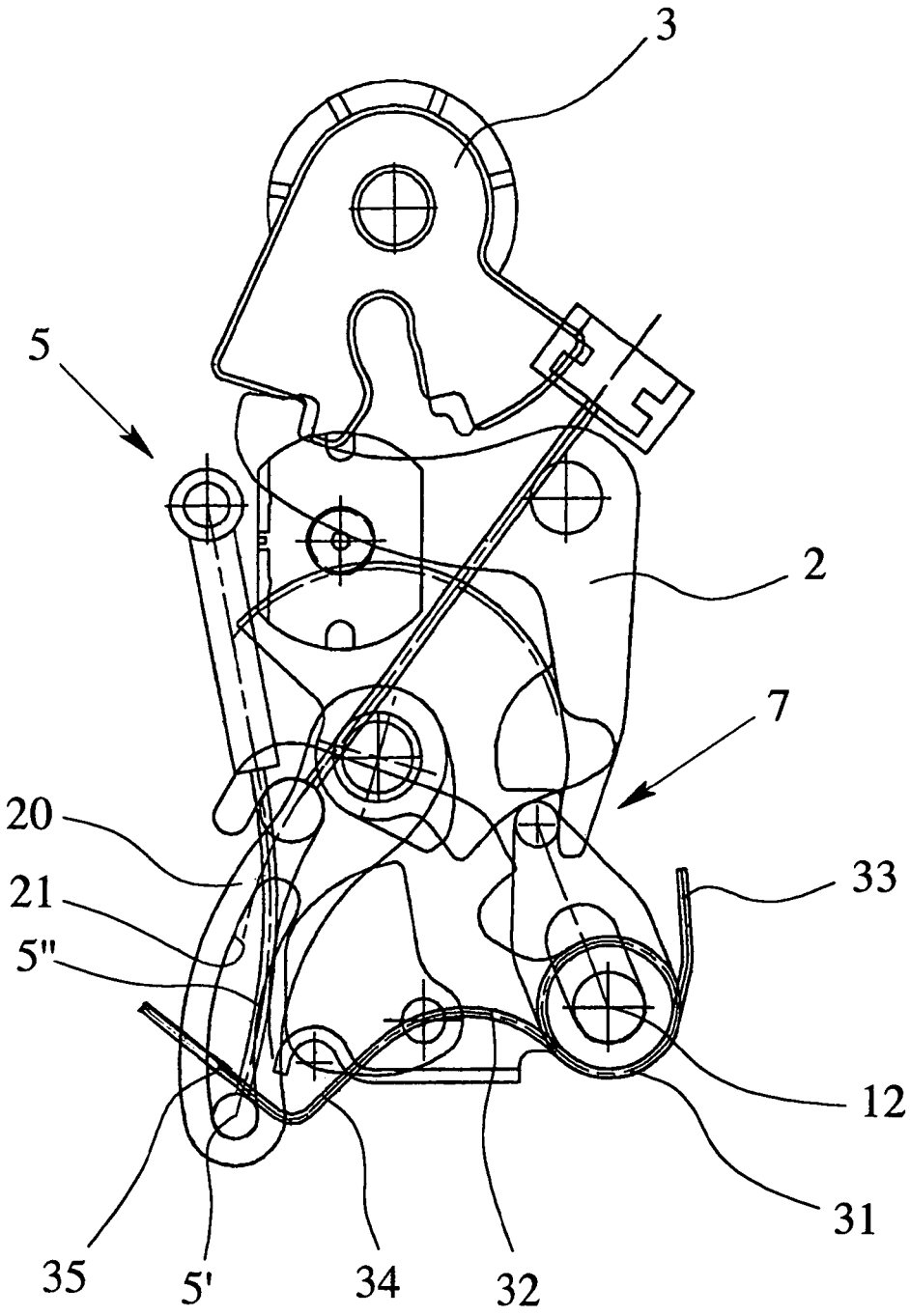
FIG. 11 shows the motor vehicle lock from FIG. 10 in the CS operating state.
Figure 12:
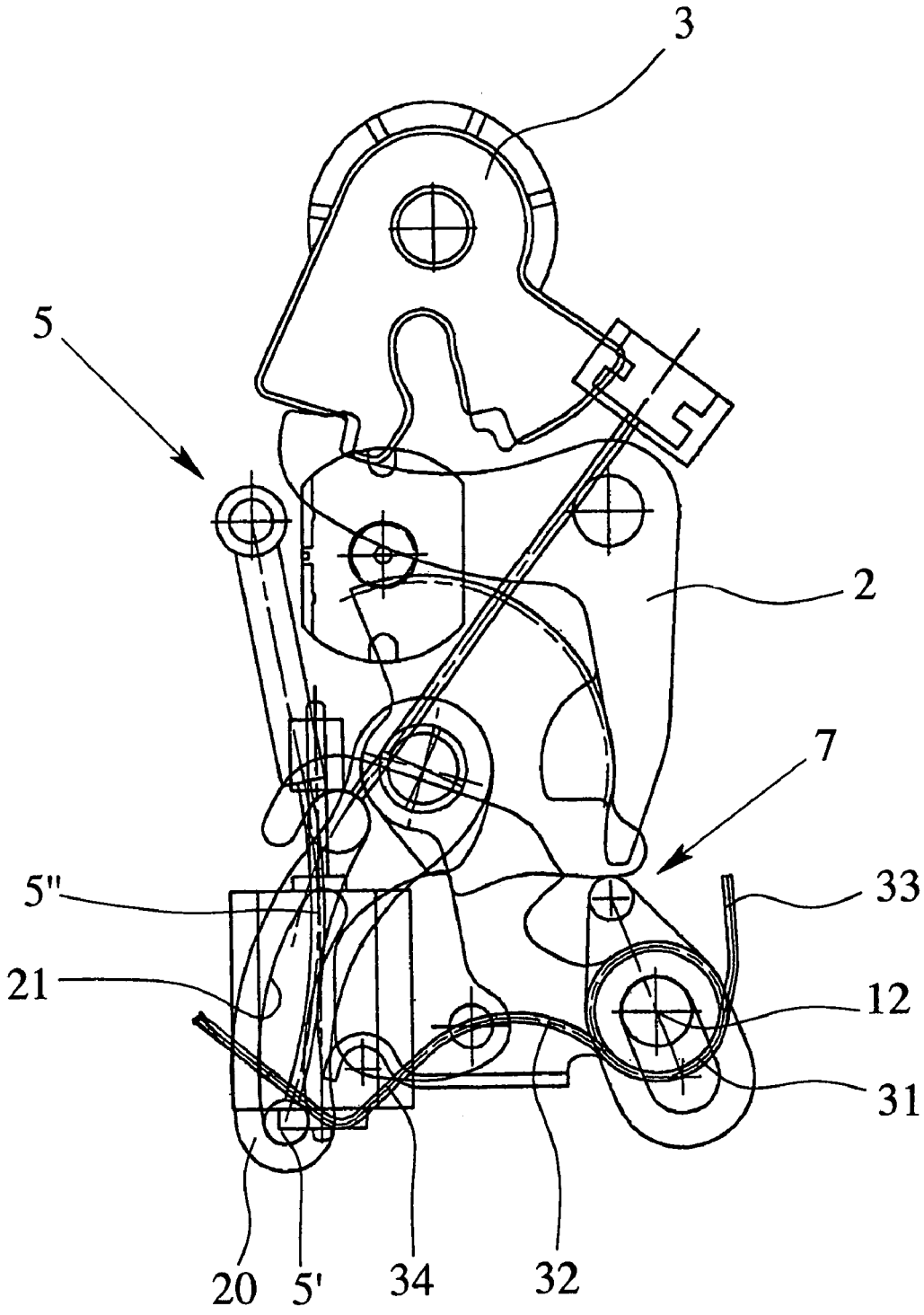
FIG. 12 shows the motor vehicle lock from FIG. 10 in the DL operating state.

The ejection lever 20 is pivotally supported and has a slot 21 in which the pin 5' of a Bowden cable 5" of the internal actuation chain 5 runs. The ejection lever 20 is in the UL (FIG. 10) and CL operating states of the control means 7 in its normal position. In the CS (FIG. 11) and DL (FIG. 12) operating states it is swung out of its normal position. Depending on the configuration of the control means 7, the ejection lever 20 can be moved back and forth between its operating positions manually and/or by a motor by the drive 17'.

In addition, the motor vehicle lock 1 described here has a spring 31 which is made as a leg spring with two legs 32, 33. The spring 31 here is supported stationary on the pivot pin 12. The Bowden cable 5' of the internal actuation chain 5 is spring-actuated by the spring 31 in the direction of its initial position. The initial position of the Bowden cable 5" here is the position in which the Bowden cable 5" is located when the inside door handle 8 is not actuated and the control means 7 is in the UL operating state (FIG. 10).

In addition to the spring actuation function for the Bowden cable 5", the spring 31 has a second function. In this second function, the spring 31 provides an end position safeguard for the ejection lever 20 of the control means 7. The concept of "end position safeguard" here means that the ejection lever 20 is held in its set position by the spring 31. This can take place by it being pressed actively into this position by the spring 31 by means of spring force. Alternatively, in this position of the ejection lever 20, the spring 31 can also adjoin it untensioned, movement of the ejection lever 20 out of this position being possible only against spring force.

In the embodiment shown here (FIGS. 11, 12), for the second function, the ejection lever 20 essentially adjoins only the spring 31. However, this does not preclude the spring 31 being slightly tensioned in contact with the ejection lever 20.

So that the spring 31 can be used for these two functions, it must be shaped accordingly. The spring 31 here preferably has a respective contour 34, 35 for each of its functions. The two contours 34, 35 are preferably located here on the same leg 32 of the spring 31 so that the components which are affected by the two functions of the spring 31, specifically the Bowden cable 5" and the ejection lever 20, interact with the same leg 32 of the spring 31. The ejection lever 20, itself, interacts with the leg 32 of the spring 31 only to the extent that it is spring-actuated by the support of the Bowden cable 5" in the slot 21 of the ejection lever 20 with respect to the second function of the spring 31. The other leg 33 of the spring 31, conversely, adjoins a fixed stop (not shown) of the motor vehicle lock 1.

The contour 34 for the first function of the spring 31 is formed by the leg 32 of the spring 31, here preferably, being bent opposite the direction of bending of the actual coiling of the spring 31. This bend and the straight sections of the leg 32 of the spring 31, which are optionally located in the bend or adjoining it, form the contour 34 for the first function. This first contour 34 is adjoined by the pin 5' of the Bowden cable 5" such that the Bowden cable 5" is spring-actuated in the direction of its initial position. This means that the pin 5' of the Bowden cable 5" in the normal position adjoins the contour 34 of the spring 31, but the spring 31 is essentially not tensioned.

Proceeding from the spring coiling, the leg 32 of the spring 31 is bent a second time behind the first contour 34. The second bend takes place opposite the direction of the first bend of the leg 32. The second bend of the leg 32 takes place preferably by about 90°. However, also much greater and smaller bending angles are possible. The bending radius here is preferably so small that the leg 32 of the spring 31 is essentially kinked.

The area behind the second bend of the leg 32 of the spring 31 forms the second contour 35 for the second function of the spring 31. The spring 31 is used in its second function as contact for the ejection lever 20 when the control means 7 is in the DL or CS operating states. Only in these operating states is the ejection lever 20 moved out of its normal position. The pin 5' of the Bowden cable 5" which is guided in the slot 21 of the ejection lever 20 then adjoins the second contour 35 of the spring 31. The second contour 35 thus forms the stop for the second function of the spring 31.

The ejection lever 20 is thus spring-loaded by the interaction with the Bowden cable 5" into the position which corresponds to the DL and CS operating states of the control means 7. The spring 31 here interacts with the cable core of the Bowden cable 5" such that the ejection lever 20 in this position is pre-tensioned by the spring action of the Bowden cable core in the transverse direction against the contour 35 of the spring 31, which contour is used as a stop. The spring action of the Bowden cable core in the transverse direction is the result of the inherent elasticity of the Bowden cable core. The transverse direction is defined as the direction essentially transverse to the lengthwise extension of the Bowden cable 5". The spring action of the core of the Bowden cable 5" accurately defines the position of the ejection lever 20.

Instead of the spring action of the core of the Bowden cable 5" or in addition to it, the ejection lever 20 can also be pre-tensioned by an additional spring (not shown) against the contact.

The contour 35 is made so long here that, when the inside door handle 8 is actuated when the control means 7 is in the CS (FIG. 11) or DL (FIG. 12) operating state, the pin 5' of the Bowden cable 5" cannot press the spring 31 to the side and slide past it. Instead, the spring 31 is tensioned when the inside door handle 8 is actuated such that the pin 5' of the Bowden cable 5" returns to its original position after the inside door handle 8 is released.

Instead of simply lengthening the contour 35 of the leg 32 of the spring 31, the end of leg 32 can also be bent a third time. In this way, it is likewise possible to prevent the pin 5' from slipping past the spring 31.

It is apparent that the spring 31, on the one hand, is a simple reset spring for the Bowden cable core, and on the other hand, due to the contours 34, 35, it has the function of a tilt spring in the sense of an end position safeguard of the Bowden cable core and ejection lever 20.

What is claimed is:

1. Motor vehicle lock, comprising:

a ratchet, a latch, an actuation lever, an internal actuation force transmission chain, an external actuation force transmission chain, and a control means for controlling operation of the lock, wherein the ratchet has an engagement position in which it holds the latch in a closed position, and has a raised position in which the latch is released, the ratchet being movable from the engagement position into the raised position by means of the actuating lever, wherein the control means has a plurality of different operating states and depending on the operating state of the control means, the ratchet is actuatable via the actuation lever by means of the internal actuation force transmission chain from an inside door handle and by means of the external actuation force transmission chain from an outside door handle and can be precluded from being actuated at all, the control means having a base state in which the internal actuation force transmission chain and the external actuation force transmission chain are coupled to the actuation lever and, wherein at least one of the internal actuation force transmission chain and the external actuation force transmission chain is adapted to be decoupled from the actuation lever by the control means depending on the operating state, wherein the control means has a central locking clutch by which unlock (UL) and center lock (CL) operating states can be turned on, and wherein the control means has an overriding lever which is moveable by means of the internal actuation force transmission chain by actuation of the inside door handle such that the central locking clutch is movable from a position which corresponds to the center lock operating state into its position which corresponds to the unlock operating state.

2. Motor vehicle lock as claimed in claim 1, wherein at least one of the internal actuation force transmission chain and the external actuation force transmission chain is supported with respect to the actuation lever such that said one of said force transmission chains is not entrained by means of the other of said force transmission chains when the actuation lever is actuated.

3. Motor vehicle lock as claimed in claim 2, wherein at least one of the internal actuation force transmission chain and the external actuation force transmission chain is guided to strike the actuation lever on only one side.

4. Motor vehicle lock as claimed in claim 1, wherein at least one of the internal actuation force transmission chain and the external actuation force transmission chain comprises a Bowden cable.

5. Motor vehicle lock as claimed in claim 1, wherein actuation by the internal actuation force transmission chain and actuation by the external actuation force transmission chain are adapted to produce movement of the actuation lever in the same direction of motion.

6. Motor vehicle lock as claimed in claim 1, wherein the ratchet and the actuation lever are decoupled in the center lock operating state.

7. Motor vehicle lock as claimed in claim 1, wherein the central locking clutch has a cam with which the ratchet and the actuation lever are coupled by action in the unlock operating state of the control means and are decoupled in terms of action in the center lock operating state.

8. Motor vehicle lock as claimed in claim 1, wherein the control means has a central locking lever with which the central locking clutch is movable from a position which corresponds to the unlock operating state of the control means into a position which corresponds to the center lock operating state.

9. Motor vehicle lock as claimed in claim 8, wherein the control means has a central locking drive for motorized driving of the central locking lever.

10. Motor vehicle lock as claimed in claim 9, wherein the central locking drive also is an opening drive and the ratchet is movable by means of the central locking drive in the opening function from the engagement position into the raised position, wherein the opening function takes place in the first direction of motion of the central locking drive and wherein a range of motion of the central locking drive in the central locking function coincides at least in part with a range of motion of the central locking drive in the opening function.

11. Motor vehicle lock as claimed in claim 10, wherein the control means has an opening clutch with an opening readiness position and an initial position, and wherein the opening readiness position can be assumed by the opening clutch after completion of the motion of the central locking drive in the second direction of motion.

12. Motor vehicle lock as claimed in claim 11, wherein, when the opening clutch is in the opening readiness position, the ratchet is raisable by the motion of the central locking drive in the first direction of motion, but cannot be raised by the motion of the central locking drive in the second direction of motion.

13. Motor vehicle lock as claimed in claim 8, wherein the central locking lever positively engages the central locking clutch in the center lock operating state of the control means.

14. Motor vehicle lock as claimed in claim 1, wherein a single stroke of the inside door handle is adapted to move the control means into the unlock operating state and the ratchet into the raised position.

15. Motor vehicle lock as claimed in claim 1, wherein a first stroke of the inside door handle moves the control means into the unlock operating state, and wherein a second stroke of the inside door handle moves the ratchet into its raised position.

16. Motor vehicle lock as claimed in claim 1, wherein the control means has a double lock (DL) operating state in which the ratchet cannot be actuated either by the internal actuation force transmission chain or by the external actuation force transmission chain.

17. Motor vehicle lock as claimed in claim 16, wherein, in the double lock operating state, the central locking clutch is in a position which corresponds to the center lock operating state and the internal actuation force transmission chain is decoupled from the actuation lever.

18. Motor vehicle lock as claimed in claim 17, wherein the internal actuation force transmission chain is adapted for being swung out of an action range of the actuation lever.

19. Motor vehicle lock as claimed in claim 17, wherein the internal actuation force transmission chain has an ejection lever for decoupling of the internal actuation force transmission chain from the actuation lever.

20. Motor vehicle lock as claimed in claim 19, wherein the ejection lever has a slot in which a pin of the internal actuation force transmission chain runs.

21. Motor vehicle lock as claimed in claim 17, wherein the control means has a drive for implementation of the double lock or center lock operating state, and wherein the internal actuation force transmission chain is adapted to be decoupled from the actuation lever by a motor.

22. Motor vehicle lock, comprising:

a ratchet, a latch, a control means for controlling operation of the lock, wherein the ratchet has an engagement position in which it holds the latch in a closed position, and has a raised position in which the latch is released, wherein the control means has a central locking drive, and is adapted for being switched by means of the central locking drive in a first direction of motion from a center lock (CL) operating state into an unlock (UL) operating state and in a second direction of motion from the unlock operating state into the center lock operating state, wherein the ratchet is adapted to be moved manually from the engagement position into the raised position by means of an internal actuation chain from an inside door handle and by means of an external actuation chain from an outside door handle, wherein depending on the operating state of the control means, the internal actuation chain and the external actuation chain are either active or inactive with respect to manual actuation of the ratchet, the internal and external actuation chains being rendered inactive by an element of the control means driven by the central locking drive, wherein the central locking drive is also adapted to function as a motorized opening drive, wherein the ratchet is movable from the engagement position into the raised position by means of the central locking drive in an opening function, the opening function being produced by motion of the driven element by said motorized opening drive, and wherein a rotational range of motion of the driven element for rendering the internal and external actuation chains inactive coincides at least in part with the rotational range of motion of the driven element for producing the motorized opening function.

23. Motor vehicle lock as claimed in claim 22, wherein the driven element is a central locking lever which is drivable by a motor by means of the central locking drive.

24. Motor vehicle lock as claimed in claim 23, wherein the central locking lever has a control contour for the opening function.

25. Motor vehicle lock as claimed in claim 24, wherein the control contour is a worm cam.

26. Motor vehicle lock as claimed in claim 22, wherein the control means has an opening clutch with an opening readiness position and an initial position, and wherein the opening readiness position is assumed by the opening clutch after completion of the motion of the central locking drive in the second direction of motion.

27. Motor vehicle lock as claimed in claim 26, wherein the opening clutch has a cam which in the opening readiness position can be caused to engage to the ratchet and wherein the control contour when the opening clutch is in the opening readiness position can be caused to engage the cam of the opening clutch.

28. Motor vehicle lock as claimed in claim 26, further comprising an outside door handle, wherein the opening clutch is pre-tensioned in the direction of the opening readiness position, wherein the opening clutch is held in an initial position by the outside door handle which has not been actuated and can be released from its initial position by actuation of the outside door handle and only then can it be moved into its opening readiness position.

29. Motor vehicle lock as claimed in claim 26, further comprising a clutch carrier for the opening clutch, wherein the clutch carrier has a slot and wherein the opening clutch is supported in the slot.

30. Motor vehicle lock as claimed in claim 29, wherein the clutch carrier has a stop for the opening clutch, and wherein the opening clutch is pre-tensioned in a direction toward the stop.

31. Motor vehicle lock as claimed in claim 26, wherein, when the opening clutch is in the opening readiness position, the ratchet is raisable by motion of the central locking drive in the first direction of motion, but cannot be raised by the movement of the central locking drive in the second direction of motion.

32. Motor vehicle lock, comprising:

a ratchet, a latch, an actuation lever, an internal actuation force transmission chain, an external actuation force transmission chain, and a control means for controlling operation of the lock, wherein the ratchet has an engagement position in which it holds the latch in a closed position, and has a raised position in which the latch is released, the ratchet being movable from the engagement position into the raised position by means of the actuating lever, wherein the control means has a plurality of different operating states and depending on the operating state of the control means, the ratchet is actuatable via the actuation lever by means of the internal actuation force transmission chain from an inside door handle and by means of the external actuation force transmission chain from an outside door handle and can be precluded from being actuated at all, the control means having a base state in which the internal actuation force transmission chain and the external actuation force transmission chain are coupled to the actuation lever, wherein at least one of the internal actuation force transmission chain and the external actuation force transmission chain is adapted to be decoupled from the actuation lever by the control means depending on the operating state, further comprising a spring which, in a first function, spring-actuates an element of one of the actuation force transmission chains in one direction in the sense of a reset spring, and wherein the spring has a second function which provides an end position safeguard for said element of said one of the actuation force transmission chains in the sense of a tilt spring.

33. Motor vehicle lock as claimed in claim 32, wherein the spring has a separate contour for performing each of said first and second functions.

34. Motor vehicle lock as claimed in claim 33, wherein the spring is a leg spring and both of said contours are on the same leg of the leg spring.

35. Motor vehicle lock as claimed in claim 34, wherein said leg of the spring is bent into the contour for the first function and the contour for the second function of the spring.

36. Motor vehicle lock as claimed in claim 32, wherein the spring is a leg spring.

37. Motor vehicle lock as claimed in claim 32, wherein the spring interacts with the element such that the spring essentially forms a contact point for the element when the inside door handle is not actuated and wherein the element is spring-actuated by the spring in the direction of its initial position.

38. Motor vehicle lock as claimed in claim 37, wherein said one of the actuation force transmission chains comprises a Bowden cable, and wherein the spring interacts with a core of the Bowden cable such that the element, in the operating positioning in which the spring forms said contact point, is pre-tensioned by the spring action on the Bowden cable core in a transverse direction counter to the contact.

39. Motor vehicle lock, comprising:

a ratchet, a latch, an actuation lever, an internal actuation force transmission chain, an external actuation force transmission chain, and a control means for controlling operation of the lock, wherein the ratchet has an engagement position in which it holds the latch in a closed position, and has a raised position in which the latch is released, the ratchet being movable from the engagement position into the raised position by means of the actuating lever, wherein the control means has a plurality of different operating states and depending on the operating state of the control means, the ratchet is actuatable via the actuation lever by means of the internal actuation force transmission chain from an inside door handle and by means of the external actuation force transmission chain from an outside door handle and can be precluded from being actuated at all, the control means having a base state in which the internal actuation force transmission chain and the external actuation force transmission chain are coupled to the actuation lever, wherein at least one of the internal actuation force transmission chain and the external actuation force transmission chain is adapted to be decoupled from the actuation lever by the control means depending on the operating state, further comprising a spring which, in a first function, spring-actuates a means for changing the operating state in one direction in the sense of a reset spring, and wherein the spring has a second function which provides an end position safeguard for said means for changing the operating state in the sense of a tilt spring.

40. Motor vehicle lock as claimed in claim 39, wherein the means for changing the operating state is an ejection lever with which the internal actuation force transmission chain can be decoupled from the actuation lever.

* * * * *